US010267006B2

(12) United States Patent
Elmer

(10) Patent No.: US 10,267,006 B2
(45) Date of Patent: Apr. 23, 2019

(54) HYDRAULIC NOISE SUPPRESSOR AND METHOD FOR HANDLING A HYDRAULIC NOISE SUPPRESSOR

(71) Applicant: Karl-Heinz Elmer, Neustadt am Ruebenberge (DE)

(72) Inventor: Karl-Heinz Elmer, Neustadt am Ruebenberge (DE)

(73) Assignee: Karl-Heinz Elmer, Neustadt am Ruebenberge (DE)

( * ) Notice: Subject to any disclaimer, the term of this patent is extended or adjusted under 35 U.S.C. 154(b) by 0 days.

(21) Appl. No.: 15/513,162

(22) PCT Filed: Sep. 14, 2015

(86) PCT No.: PCT/DE2015/100391

§ 371 (c)(1),
(2) Date: Mar. 22, 2017

(87) PCT Pub. No.: WO2015/185041

PCT Pub. Date: Dec. 10, 2015

(65) Prior Publication Data

US 2017/0306582 A1 Oct. 26, 2017

(30) Foreign Application Priority Data

Sep. 22, 2014 (DE) ..... 10 2014 113 676

(51) Int. Cl.
*E02D 13/00* (2006.01)
*E02D 7/02* (2006.01)
(Continued)

(52) U.S. Cl.
CPC ..... *E02D 13/005* (2013.01); *E02D 7/02* (2013.01); *E02D 27/525* (2013.01)

(58) Field of Classification Search
CPC ..... E02D 13/00; E02D 13/005; E02D 7/02; E02D 27/52; E02D 27/525; E04B 1/8209; E04B 1/8227; E04B 2001/8263
(Continued)

(56) References Cited

U.S. PATENT DOCUMENTS

2009/0129871 A1* 5/2009 Mohr ..... E02D 7/02 405/232
2011/0031062 A1* 2/2011 Elmer ..... E02B 17/0017 181/175
(Continued)

FOREIGN PATENT DOCUMENTS

DE 102004043128 A1 3/2006
DE 102006008095 A1 8/2007
(Continued)

*Primary Examiner* — Frederick L Lagman
*Assistant Examiner* — Stacy N Lawson
(74) *Attorney, Agent, or Firm* — Leydig, Voit & Mayer, Ltd.

(57) ABSTRACT

A hydraulic noise suppressor for reducing water-borne noise, and method for handling the same, especially in the area of a construction site when an object is driven into underwater soil. The hydraulic noise suppressor can have at least two rigid holding elements, at least one support structure, and noise reducing elements secured to the at least one support structure, an upper end of the at least one support structure being secured to at least one of the at least two holding elements. The hydraulic noise suppressor can be divided along lateral flanks extending between the upper end and an opposite lower end of the at least one support structure.

16 Claims, 11 Drawing Sheets

(51) Int. Cl.
*G10K 11/16* (2006.01)
*E02D 27/52* (2006.01)

(58) Field of Classification Search
USPC ..... 405/63–72, 224, 228, 232
See application file for complete search history.

(56) References Cited

U.S. PATENT DOCUMENTS

| | | | | |
|---|---|---|---|---|
| 2012/0097476 | A1* | 4/2012 | Jung | E02D 7/14 181/196 |
| 2015/0078833 | A1 | 3/2015 | Elmer | |
| 2015/0110564 | A1* | 4/2015 | West | E02D 3/10 405/227 |
| 2015/0191987 | A1* | 7/2015 | Wochner | E21B 33/10 181/210 |

FOREIGN PATENT DOCUMENTS

| | | | | |
|---|---|---|---|---|
| DE | 102008017418 | A | 10/2009 | |
| DE | 102012206907 | A1 | 10/2013 | |
| GB | 2509208 | A | 6/2014 | |
| WO | WO-2013102459 | A2 * | 7/2013 | E02D 13/00 |
| WO | WO 2013102459 | A2 | 7/2013 | |

* cited by examiner

HYDRAULIC NOISE SUPPRESSOR AND METHOD FOR HANDLING A HYDRAULIC NOISE SUPPRESSOR

CROSS-REFERENCE TO RELATED APPLICATIONS

This application is a U.S. national stage application under 35 U.S.C. § 371 of International Application No. PCT/DE2015/100391, filed on Sep. 14, 2015, and claims benefit to German Patent Application No. DE 10 2014 113 676.4, filed on Sep. 22, 2014. The International Application was published in German on Dec. 10, 2015, as WO 2015/185041 A2 under PCT Article 21(2).

FIELD

The invention relates to an underwater sound damper for reducing waterborne sound.

BACKGROUND

When carrying out work underwater, in particular when inserting an object into the underwater floor, the resultant sound is radiated from the object into the water surrounding it. Underwater sound dampers are known for reducing underwater sound, also referred to as waterborne sound, i.e. the sound in the water.

Underwater floors are understood to mean the fixed floor body below a water column. An underwater floor in the context of the present invention is a seafloor or the bed of a dock or inland water such as a lake or river. The objects that are usually inserted into the underwater floor when carrying out work underwater are foundation bodies such as piles or construction parts such as wall elements, which are inserted by means of drilling or driving into the underwater floor. Within the context of the invention, other sound-emitting devices such as a drilling pipe can also be understood as objects to be inserted into the underwater floor.

When drilling, vibrational driving or pulsed driving, considerable sound emissions are emitted from the object inserted into the underwater floor, but also from the underwater floor, into the surrounding water. The sound is produced at the friction surface between the object and the underwater floor and is transmitted therefrom into the surrounding water.

Underwater sound, as is produced when working underwater as described above, can be perceived by marine mammals, such as porpoises and seals, over large distances. Any animal that uses its hearing for communication, orientation and for foraging is in particular adversely affected by underwater sound. Permanent hearing damage can thus result in death in these animals.

Various techniques are known for reducing the sound. In a bubble curtain, compressed air tubes are laid around the edge of the underwater construction site. These are connected to compressors and pump compressed air into the tubes on the underwater floor. This compressed air rises in the form of a curtain of air bubbles and thus forms a physical-acoustic, sound-absorbing barrier.

Instead of the volatile air bubbles that are difficult to control, enveloping bodies made of resilient material can also be used as sound-reducing elements. In this case, a multiplicity of sound-reducing elements are arranged on a support structure. This is a net, for example, which can be flexibly stretched around the sound source in the water. The nets are held in place on the underwater floor by means of weights. The sound-reducing elements and the support structure are referred to as a whole as an underwater sound damper. An underwater sound damper also has a damping effect and can be adapted precisely to the expected sound spectrum. An underwater sound damper is less susceptible to sea currents and is optimally effective over the entire relevant frequency range. Furthermore, in an underwater sound damper, a continuous supply of compressed air like that needed for bubble curtains is not required.

DE 10 2008 017 418 A1 discloses an underwater sound damper for reducing underwater sound. This consists of a multiplicity of damping elements for reducing underwater sound, which are spaced apart from one another and are distributed over a support structure, for example a net. The support structure is arranged around a sound source at the operation site. A sound source is, for example, a pile that is inserted into the underwater floor by means of driving or drilling.

The generic document, DE 10 2004 043 128 A1, relates to a pile guiding apparatus for guiding a pile to be driven into the bed of a body of water, which pile is surrounded by an inner and an outer textile curtain, so that the bubbles leaving a nozzle arrangement rise between the two textile curtains. For this purpose, discharge openings are located in the radial direction between the inner textile curtain and the outer textile curtain. Since the bubbles leaving the exhaust openings and rising cannot pass either of the two textile curtains, they remain concentrated in the tube-shaped space between the two textile curtains until they reach the water surface. The nozzle arrangement consists of two rigid legs, which are connected to two joints, and therefore the nozzle arrangement can be opened in order to introduce the pile laterally into the nozzle arrangement. The movable legs are then closed so that the pile is surrounded and fixed in its correct position.

DE 10 2012 206 907 A1 discloses an apparatus for reducing the propagation of sound, vibrations and pressure surges in a liquid when inserting an object into a substrate having a plurality of damping bodies that can be filled with a gas and a support, on which the damping bodies can be arranged in a suitable position relative to one another. The support comprises a frame having vertical and horizontal pipe elements that are arranged perpendicularly to one another, which frame is movable between a closed position and an open position by means of joints. Alternatively, the frame regions made up of horizontal pipe elements can be coupled to one another by means of cables in order to allow for particularly space-saving storage or space-saving transport of the apparatus when not in use.

WO 2013/102459 A2 describes a method and an apparatus for handling an underwater sound damper in the region of an offshore construction site, in particular for a pile to be inserted into the underwater floor. The apparatus disclosed comprises a retaining device on which a first end of the underwater sound damper is retained, and a second end of the underwater sound damper that is remote from the first end of the underwater sound damper and can be positioned so as to be movable relative to the retaining device, in particular moved away from the retaining device.

Furthermore, DE 10 2006 008 095 A1 relates to shell-shaped segments made of a sound-absorbing material, which are connected by hinges and which together form a rigid sound-insulation sleeve.

GB 2509208 A also relates to a rigid sound-insulation envelope of this type.

SUMMARY

An aspect of the invention provides an underwater sound damper for reducing waterborne sound when inserting an object into an underwater floor, the underwater sound damper comprising: an upper end; a lower end, opposite the upper end; side edges extending between the upper end and the lower end; a support structure; and sound-reducing elements, wherein the underwater sound damper is separable along the side edges and movable between a closed position and an open position, wherein the support structure includes a lower end, which is fixed so as to be movable relative to at least one floor element, wherein the sound-reducing elements are fastened to the support structure and are spaced apart from one another, and wherein the support structure is formed by a row of a plurality of parallel, vertical cables and/or net strips and/or netting tubes including the sound-reducing elements, and/or wherein the support structure is formed of a net.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
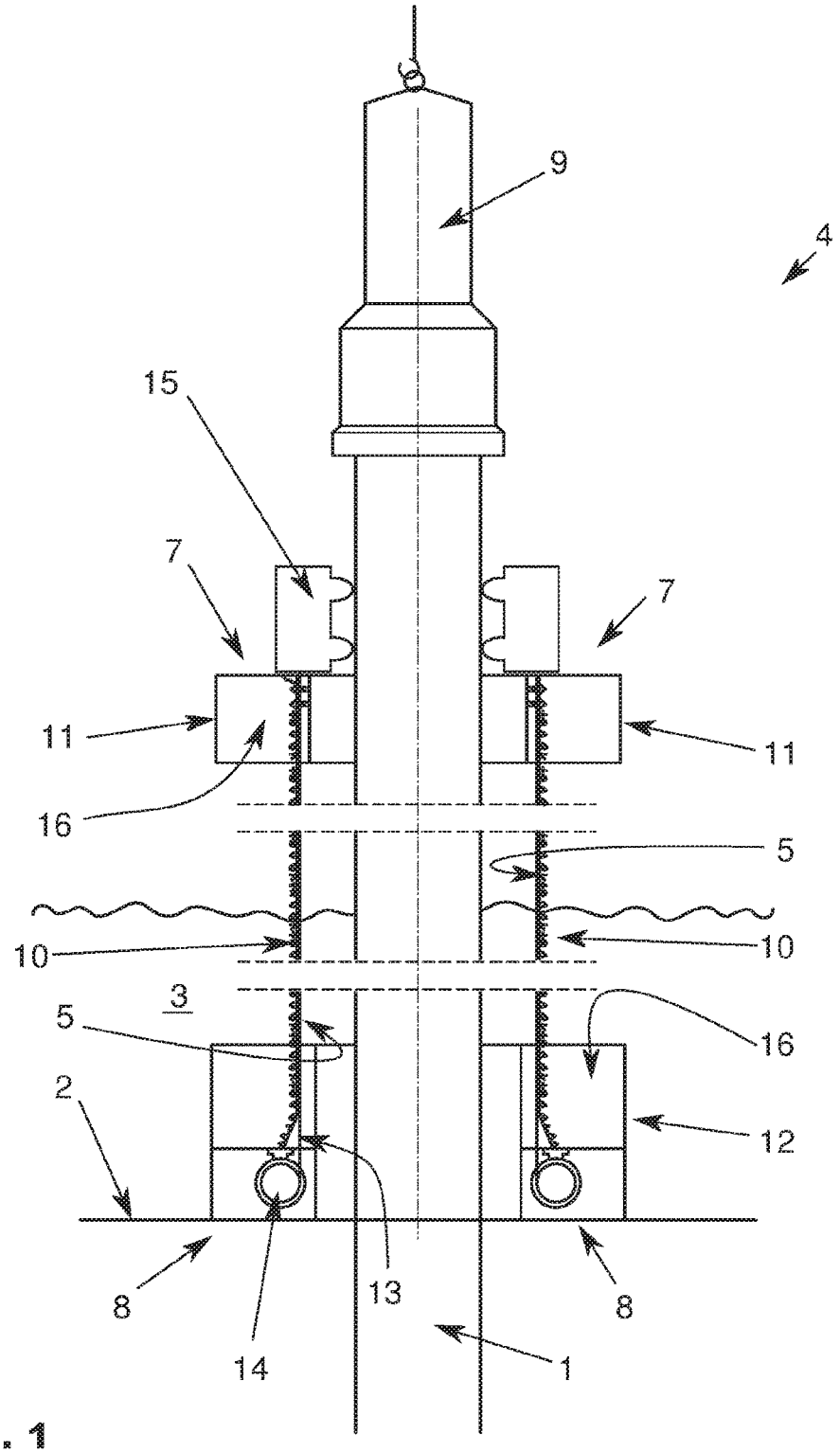
FIG. 1 a schematic sectional view of an underwater sound damper in a working position.

An aspect of the invention is to make it possible to simplify both handling of an underwater sound damper in order to reduce the production or propagation of underwater sound, and handling of the object in the region of work being carried out underwater, such as boring or driving an object into the underwater floor, such that the work processes can be carried out quickly, safely and thus ultimately cost-effectively.

An aspect of the invention also relates to a method for handling an underwater sound damper and/or for positioning an underwater sound damper in the region of a construction site for an object to be inserted into an underwater floor.

An aspect of the invention relates to an underwater sound damper for reducing waterborne sound, in particular in the region of a construction site when an object is to be inserted into an underwater floor, the underwater sound damper having an upper end and a lower end that is opposite the upper end, side edges extending between the upper end and the lower end, the underwater sound damper being separable along the side edges and being movable between a closed position and an open position, the underwater sound damper comprising at least one support structure, a lower end of the at least one support structure being fixed so as to be movable relative to the at least one floor element.

According to an aspect of the invention, the underwater sound damper comprises sound-reducing elements that are fastened to the at least one support structure and are spaced apart from one another, the support structure being formed by a row of a plurality of parallel, vertical cables provided with the sound-reducing elements and/or net strips and/or netting tubes and/or being formed of a net. As a result, both the underwater sound damper and the object are easier to handle than in known underwater sound dampers.

In the underwater sound damper according to an aspect of the invention, the side edges can move relative to one another between two end positions, that is an open position and a closed position. By the side edges moving away from one another, a body extending deep into the water, for example a vertically held pile, can quickly be moved into the region sealed off by the underwater sound damper in a simple manner. In the closed position, the side edges are positioned slightly spaced apart, are touching one another and/or are overlapping one another. In the open position, the side edges are at a large distance that is larger than the cross section of the object. Depending on the embodiment of the underwater sound damper, the side edges that are movable relative to one another are part of a single support structure, for example, and/or of separate support structures, which are formed for example by a row of a plurality of parallel, vertical cables and/or net strips and/or netting tubes that are provided with sound-reducing elements and are retained on a floor element at the lower end and can float freely at the upper end.

A net is preferably used as the support structure for the sound-reducing elements. Alternatively to a net, it is also possible to use a grating, a cage, in particular a narrow cage, a wire mat, a perforated sheet plate or a rigid wire mesh. A plurality of the rigid support structures formed as surface bodies are movable relative to one another between the idle position and the working position, preferably in a translational and/or rotary manner. In this case, the support structures are preferably arranged relative to one another in graduated planes or in concentric rings. Support structures in the form of cages can also be telescopic or can be arranged on and/or next to one another, for example in stacks.

It has proven advantageous that the upper end and the lower end of the at least one support structure are movable in a translational manner relative to one another in a vertical direction and/or in a horizontal direction that is approximately perpendicular to the vertical direction. This makes it possible to gather the support structure in order to move the underwater sound damper between the open position and the closed position or for moving the underwater sound damper to another location and to securely store it in a transport housing.

Furthermore, it is expedient that the underwater sound damper comprises at least one floor element which is assigned to the lower end of the at least one support structure, the lower end being movable relative to the at least one floor element or being fixed to the at least one floor element. The at least one floor element can be moved in a translational manner in a vertical direction relative to the retaining elements so that the at least one support structure can be expanded or gathered together as a result of the vertical movement of the at least one floor element. This is possible by the lower end of the support structure being fastened to the floor element. Furthermore, the vertical movability of the at least one floor element is advantageous since the at least one floor element can thus be raised from the underwater floor when the underwater sound damper is displaced, making it easier to handle the underwater sound damper. In an underwater sound damper in which the lower end is movable relative to the at least one floor element, the floor element comprises an underwater hoist or deflection roller in order to expand the support structure. The at least one floor element is also used as a mass body that acts against the buoyancy of the sound-reducing elements.

The at least one floor element is movable in the vertical direction between an idle position and a working position, it resting on the underwater floor when in the working position and resting on or being locked to at least one of the retaining elements in the idle position. In order to move said floor element between the working position and the idle position, the retaining elements are connected to the at least one floor element by the support structures and/or by means of cables. The cables can also be formed as bars. The support structures are preferably movably arranged on the cables or bars.

The at least one floor element and the retaining elements can be formed as containers having closed walls. However, it has proven advantageous for the at least one floor element and the retaining elements to be designed as cages having walls through which a flow can pass in order for a flow to pass through the underwater sound damper.

The underwater sound damper preferably comprises a plurality of floor elements, at least one floor element being movable in parallel with a horizontal plane together with one of the retaining elements.

In order to insert a pile into the underwater floor, it has proven useful for the underwater sound damper to comprise a guide device for a pile, for example a gripper, comprising at least one movable arm for gripping the pile, a retaining element being fastened to the at least one movable arm of the guide device. This makes it possible for the underwater sound damper and the guide device to move between the open position and the closed position. Alternatively or in addition, it is possible for at least one retaining element to be fixed to the hull of a vessel or to be connected to a lifting device, for example a crane or pivot arm, that is fastened to the vessel. A vessel or constructor vessel in the context of the invention is a device that floats and/or is set down on the underwater bed or onshore on the water's edge.

The underwater sound damper can also be completely independent of a constructor vessel or a guide device. It is therefore possible, for example, for the underwater sound damper, at least one retaining element and/or floor element to be connected to the object by means of at least one movable arm.

In the closed position, the guide device usually surrounds approximately two-thirds of the pile, in any case more than half the circumference thereof. By contrast, the underwater sound damper preferably surrounds the entire pile. In order to be able to quickly switch between the open position and the closed position, the underwater sound damper preferably comprises a plurality of elements, for example retaining elements, in one plane, which are interconnected by means of bearings. An underwater sound damper therefore consists of four quadrant-shaped retaining elements, for example, which are interconnected by three rotational joints.

Furthermore, it is also possible to provide intermediate elements, which are still floating in the water, in addition to the retaining elements and the floor elements, in particular for use at great depths or in strong currents.

The bearings for connecting the elements to one another can be designed as pivot bearings or plain bearings for rotary or translational movement. It is possible for the elements of an underwater sound damper to be connected by means of different types of bearings. For example, an underwater sound damper can be provided with four retaining elements, which comprise a sliding mechanism in the form of a bearing between the two middle retaining elements, and in which the outer retaining elements are connected to the middle retaining elements by means of rotational joint. The arrangement of the bearings or the shape and extension of the elements can be either symmetrical or asymmetrical.

According to the invention, the object is also achieved by a method according to the features of claim 7. The additional embodiment of the invention can be found in the dependent claims.

The invention provides a method in which, in order to move the object through the plane of the underwater sound damper, said underwater sound damper is moved into an open position, in which the side edges are moved away from one another and, in order to insert the object into the underwater floor, the underwater sound damper is moved into a closed position, in which the side edges are moved towards one another. This option of vertically dividing and opening the underwater sound damper like a curtain makes it easier to position the object and to transport it through the plane of the underwater sound damper.

According to another embodiment of the method, an object is first moved into the insertion position by an insertion apparatus. A guide device and at least two retaining elements of the underwater sound damper are then moved out of an open position into a closed position, the object being retained by the guide device such that it cannot move horizontally and being surrounded by the retaining elements. The underwater sound damper is then expanded, a lower end of the underwater sound damper being moved up to the underwater floor or as far as a floor element resting on the underwater floor. The object is then inserted into the underwater floor by means of the insertion apparatus. The underwater sound damper is then pulled together at least in part, the lower end being moved away from the underwater floor. The guide device and the at least two retaining elements are then moved out of the closed position and into the open position, releasing the object. This simplifies handling of the object and the underwater sound damper.

In an underwater sound damper having a single support structure, in order to reach the closed position the distance between the side edges extending between an upper end and a lower end of the support structure is reduced. In an underwater sound damper comprising at least two support structures, in order to reach the closed position the distance between two side edges of different support structures is reduced.

The guide device and the retaining device can in principle be moved between the open position and the closed position independently of one another. It has proven particularly useful for the guide device and the at least two retaining elements to be collectively moved, in particular simultaneously, between the open position and the closed position.

However, embodiments also exist in which it has proven useful for the guide device and the at least two retaining elements to be moved asynchronously, or independently of one another. The individual elements, for example the retaining elements of an underwater sound damper, can also be moved synchronously or independently of one another.

It is also expedient for the at least one support structure to be completely pulled together before each movement of the at least two retaining elements, in particular the at least one floor element is moved into the idle position.

When carrying out work underwater, in particular when inserting an object 1 into the underwater floor 2, the resultant sound is radiated from the object 1 into the water 3 surrounding it. In order to reduce the underwater sound, also referred to as waterborne sound, i.e. the sound in the water 3, an underwater sound damper 4 is provided, a few embodiments of which are described in more detail in the following. The method according to the invention is also explained by the embodiments of the underwater sound damper 4 shown in the drawings.

The method is used for handling the underwater sound damper 4 in the region of an off-shore construction site, in particular for an object 1 to be inserted into the underwater floor 2.

The underwater sound damper 4 is particularly effective when the sound source, the object 1 in this case, is surrounded by the underwater sound damper 4 to the greatest possible extent. In order to position the object 1 in the underwater sound damper 4, which consists of a net for example that is formed as a flexible support structure 5 comprising sound-reducing elements 10 fastened thereto, the underwater sound damper 4 is separated along side edges 6 shown in FIGS. 4 to 9. The side edges 6 extend between an upper end 7 and a lower end 8 of the underwater sound damper 4 and are each embodied by at least one cable 13.

Figure 2:
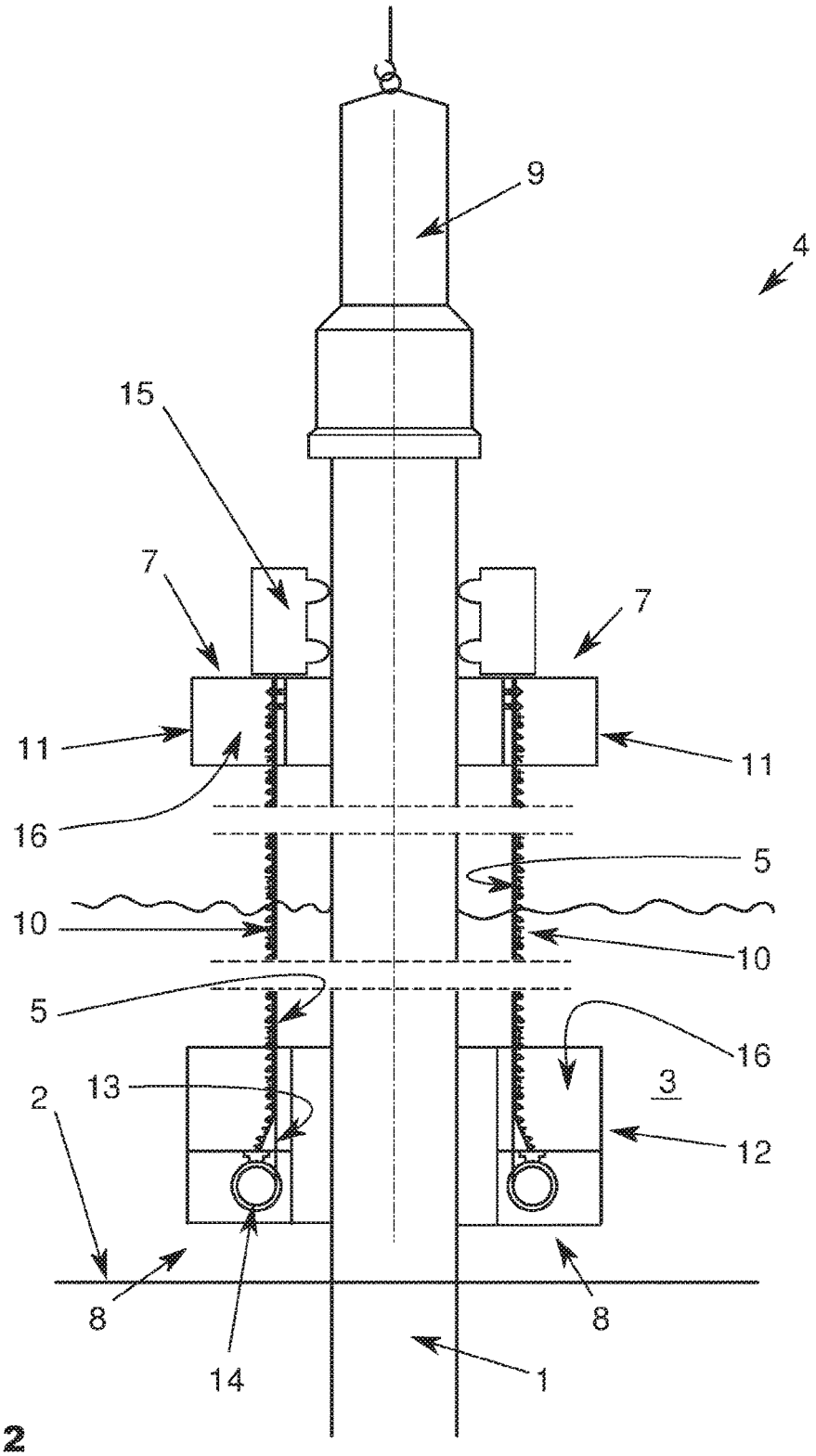
FIG. 2 a schematic sectional view of the underwater sound damper shown in FIG. 1 in an intermediate position.
Figure 3:
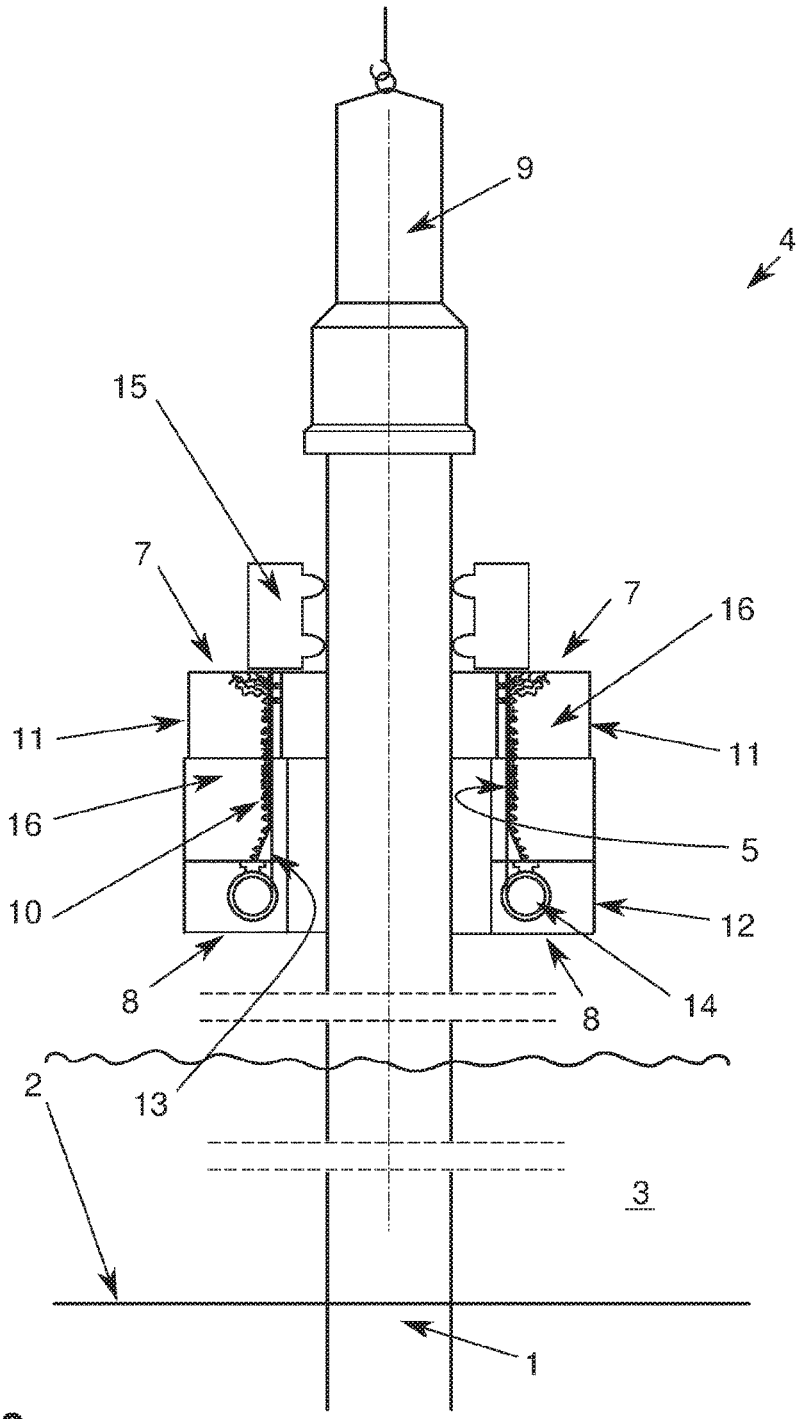
FIG. 3 a schematic sectional view of the underwater sound damper shown in FIG. 1 in an idle position.

FIGS. 1 to 3 show an object 1 inserted into the underwater floor 2 at the end of the insertion process. An insertion tool 9 is still positioned on the object 1. The underwater sound damper 4 shown schematically in section comprises the above-mentioned flexible support structure 5, to which a multiplicity of sound-reducing elements 10 are fastened. Furthermore, the underwater sound damper 4 comprises at least two rigid retaining elements 11, which are connected to the upper end 7 of the at least one support structure 5, and a guide device 15 for the erected object 1, which guide device is also referred to as a gripper. The guide device 15 prevents horizontal movement of the object 1 as it is sunk.

In the embodiment shown in FIGS. 1 to 3, the retaining elements 11 are arranged on the guide device 15. In this case, the retaining elements 11 are fixed directly to the guide device 15 as shown, or are attached to the guide device 15 by means of cables. This configuration allows the retaining elements 11 to release to the water surface, which is preferably carried out by hoists arranged on the retaining elements 11. The at least two retaining elements 11, together with the arms of the guide device 15, are moved in a horizontal plane in order to receive an object 1.

Furthermore, the underwater sound damper 4 comprises at least one floor element 12. The at least one floor element 12 is movable relative to the retaining elements 11. The at least one floor element 12 can be moved between the underwater floor 2 and the retaining elements 11 by means of the cables 13 extending between the at least one floor element 12 and the retaining elements 11. Hoists 14 are arranged on the at least one floor element 12 and/or on the retaining elements 11 as a drive. The cables 13 can also be used to guide the at least one support structure 5. In the underwater sound damper 4 according to the invention, it is also possible for a tube to be retained in the floor element 12 in order to generate a bubble curtain and/or to generate or control buoyancy. The bubble curtain and/or the buoyant body and/or the sound-reducing elements ideally have a common compressed air supply, which comprises a common line and/or a common compressor, for example. The lower end 8 of the at least one support structure 5 is connected to the at least one floor element 12 and is expanded with the releasing of the at least one floor element 12. Alternatively, the lower end 8 of the at least one support structure 5 can be moved relative to the at least one floor element 12, it being possible for the lower end 8 to be pulled towards the at least one floor element 12 by means of additional cables and hoists (not shown here). The at least one support structure 5 is retrieved merely by the buoyancy of the sound-reducing elements 10 fastened to the at least one support structure 5.

FIG. 1 shows the at least one floor element 12 in a working position. In this position, the at least one floor element 12 is set down on the underwater floor 2. When the underwater sound damper 4 is active, a curtain that reduces the underwater sound extends between the floor element 12, which is in the working position, and the retaining elements 11. The curtain is for example a support structure 5 comprising sound-reducing elements 10 fastened thereto, a bubble curtain having freely rising air bubbles or a combination of different devices for reducing waterborne sound. The water surrounding the underwater sound damper 4 can flow through the curtain; however said curtain encloses a delimited volume of water containing the sound source and thus separates said volume from the environment.

FIG. 2 shows the at least one floor element 12 in an intermediate position. In this position, the at least one floor element 12 is raised from the underwater floor 2. The distance from the underwater floor 2 is large enough for the underwater sound damper 4 to be moved away from an object 1 inserted into the underwater floor 2 and towards a new insertion location.

FIG. 3 shows the at least one floor element 12 in an idle position. In this position, the at least one floor element 12 rests against the retaining elements 11. The retaining elements 11 are optionally locked to the at least one floor element 12 in the idle position. The idle position is particularly suitable when transporting the underwater sound damper 4, since the at least one support structure 5 is securely stored in a transport housing 16. In the embodiment shown, the transport housing 16 is formed by the floor element 12 and the retaining element 11. The underwater sound damper 4 is preferably opened when in the idle position.

FIGS. 4 to 9 are schematic views of three different methods for handling an underwater sound damper 4. The drawings show the retaining elements 11, one or more floor elements 12 and the at least one support structure 5 and the cables 13 that are tensioned between the retaining element 11 and the floor element 12 when using a flexible support structure 5. Only a cut-out of the at least one support structure 5 is shown. The at least one support structure 5 can, as a single support structure 5, for example surrounding the object 1 (not shown), spatially extend downwards. The underwater sound damper 4 can also comprise a plurality of support structures 5, which are formed as a disc-like wall, for example positioned in front of the entrance to a harbor. A plurality of cables 13 are assigned to each retaining element 11, at least one cable 13 being positioned on each side edge 6.

Figure 4:
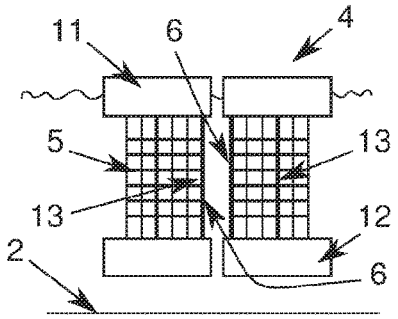
FIG. 4 a schematic view of an underwater sound damper in a closed position, comprising two retaining elements and two floor elements in an intermediate position.
Figure 5:
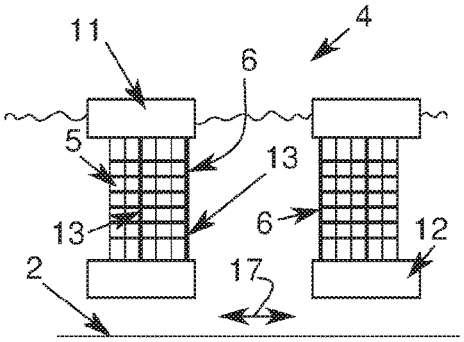
FIG. 5 a schematic view of the underwater sound damper shown in FIG. 4 in an open position.

FIGS. 4 and 5 show an underwater sound damper 4, comprising two retaining elements 11 and two floor elements 12. In order to be able to transport an object 1 (not shown here) into the working region, the underwater sound damper 4 can be divided along the side edges 6. In the variant shown, the opening and closing movement takes place while the underwater sound damper 4 is in an intermediate position. In order to open the underwater sound damper 4, the retaining elements 11 and the floor elements 12 are pivoted or displaced in pairs, so that the distance between the side edges 6 is increased. The movement 17 of the retaining elements 11 as well as the floor elements 12 and the side edges 6 is denoted by a double-headed arrow. In order to close the underwater sound damper 4, this movement 17 is reversed. FIG. 4 shows the closed position of the underwater sound damper 4. In this case, the distance between the side edges 6 is minimized. Alternatively, the side edges 6 can also be positioned so as to overlap in the closed position. FIG. 5 shows the open position of the underwater sound damper 4. In the open position, the distance between the side edges 6 is much larger than in the closed position. As already shown above, the underwater sound damper 4 shown here can consist of a support structure 5, which is connected to all the retaining elements 11 and the floor elements 12. However, the underwater sound damper 4 shown here can also consist of two independent support structures 5, each support structure being connected to a retaining element 11 and a floor element 12. In order to move 17 the floor elements 12, said elements are moved from the underwater floor 2 into the intermediate position shown or into an idle position.

Figure 6:
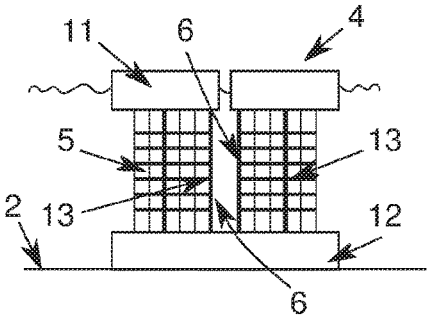
FIG. 6 a schematic view of an underwater sound damper in a closed position, comprising two retaining elements and one floor element in a working position and comprising an expanded support structure.
Figure 7:
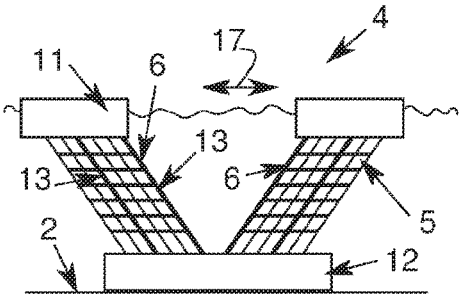
FIG. 7 a schematic view of the underwater sound damper shown in FIG. 6 in an open position.

FIGS. 6 and 7 show an underwater sound damper 4 comprising two retaining elements 11 and one floor element 12. In order to be able to transport an object 1 (not shown here) into the working region, the underwater sound damper 4 can be divided along the side edges 6. In order to open the underwater sound damper 4, the retaining elements 11 are pivoted or displaced such that a wedge-shaped opening is formed between the side edges 6. When switching between the closed position and the open position, the floor element 12 remains in the working position in contact with the underwater floor 2 and is not moved. The support structure 5 is connected to the floor element 12.

Figure 8:
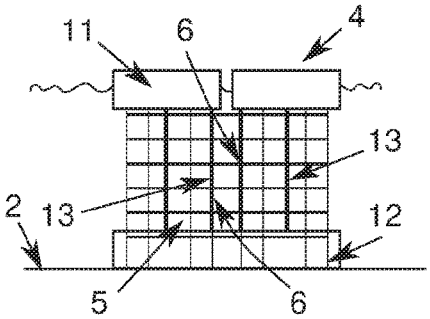
FIG. 8 a schematic view of the underwater sound damper shown in FIG. 6 in a closed position, comprising a support structure that is pulled together.
Figure 9:
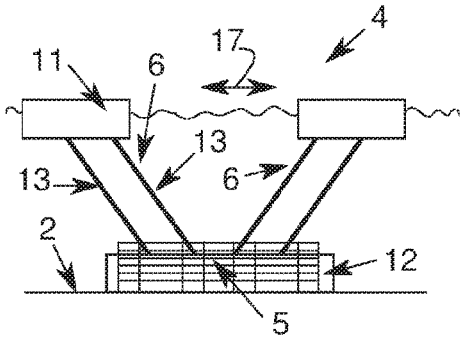
FIG. 9 a schematic view of the underwater sound damper shown in FIG. 6 in an open position, comprising a support structure that is pulled together.
Figure 10:
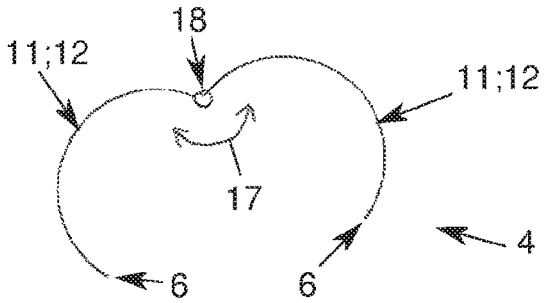
FIG. 10 a schematic plan view of an underwater sound damper.
Figure 11:
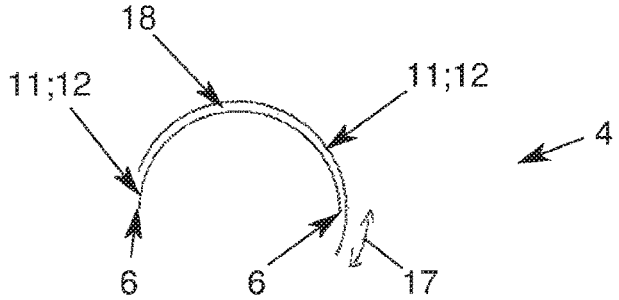
FIG. 11 a schematic plan view of an underwater sound damper.
Figure 12:
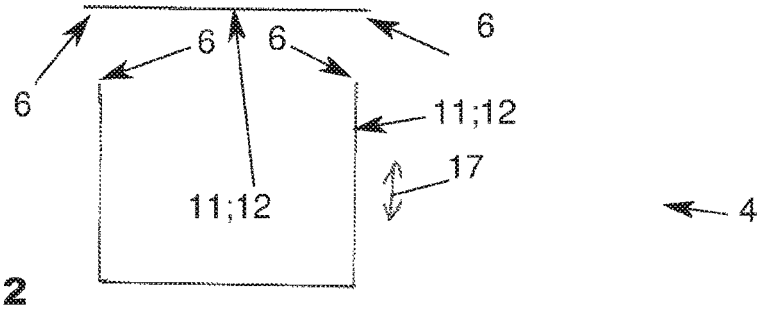
FIG. 12 a schematic plan view of an underwater sound damper.
Figure 13:
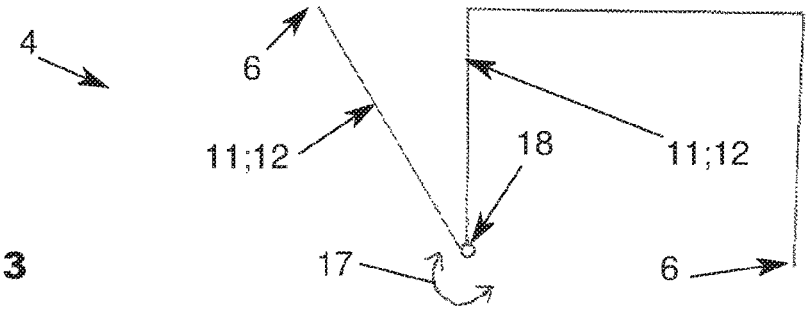
FIG. 13 a schematic plan view of an underwater sound damper.

FIGS. 8 and 9 show a variant of the method described in FIGS. 6 and 7, wherein, proceeding from the closed position in FIG. 6, the support structure 5 is first pulled away from the retaining elements 11 and the retaining elements 11 are then moved in accordance with FIG. 7 until the open position is reached.

FIGS. 10 to 24 are schematic plan views of the movement 17 at least of the retaining elements 11. The retaining elements 11, which are movable relative to one another, optionally also the floor elements 12, are connected, for example, by means of at least one bearing 18, as shown in FIGS. 10, 11, 13 to 16 and 20 to 24. The at least one bearing 18 can be formed as a joint, which allows for a rotary movement 17 between the retaining elements 11. A joint-like bearing 18 of this kind is shown in FIGS. 10, 13, 20 to 22 and 23. The bearing 18 can also be a guide, which allows for rotary or translational movement 17 between the retaining elements 11. A guide-like bearing 18 of this kind is shown in FIGS. 11, 17 to 19 and 24. The retaining elements 11, which are movable relative to one another, and optionally also the floor elements 12, can also be independent of one another, as shown in FIGS. 12 and 17 to 19.

FIGS. 14 to 22 show the method for positioning the underwater sound damper 4 and the object 1 in an offshore installation site in order to insert a pile into the underwater floor 2.

Figure 14:
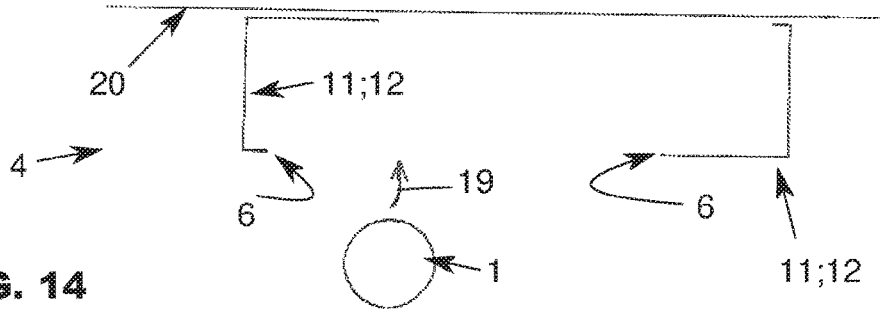
FIG. 14 a schematic plan view of an underwater sound damper in an open position.
Figure 15:
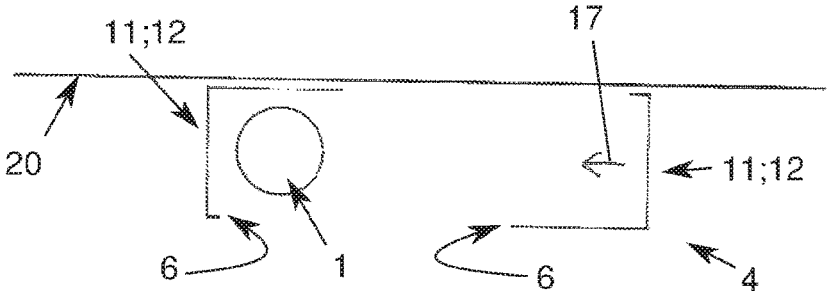
FIG. 15 a schematic plan view of the underwater sound damper shown in FIG. 14.
Figure 16:
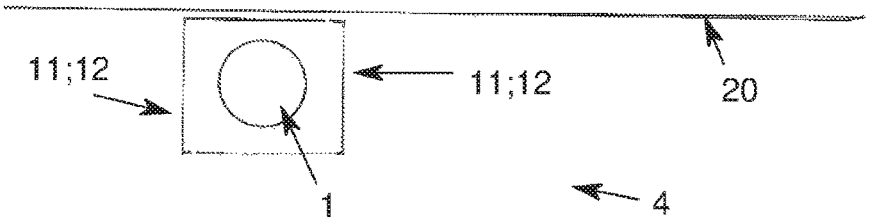
FIG. 16 a schematic plan view of the underwater sound damper shown in FIG. 14 in a closed position.

FIGS. 14 to 16 show a first variant of the method. In this first variant, a multi-part underwater sound damper 4 is provided, in which each part comprises a retaining element 11 and a floor element 12 as well as a support structure 5 (not shown), arranged therebetween. In the open position, the two parts of the underwater sound damper 4 comprise a distance (FIG. 14). This distance, in particular between the side edges 6, allows for simple, problem-free and secure positioning 19 of the object 1, which is a pile in this case. The two parts of the underwater sound damper 4 are fastened to a vessel 20. As soon as the object 1 is positioned in its insertion location, one of the parts of the underwater sound damper 4 is moved 17 towards the other part (FIG. 15) until the closed position is reached (FIG. 16). The movement 17 of one part preferably takes place along a guide fastened to the vessel 20. Provided that the support structure 5 has not yet been extended, the floor element 12 and the lower end 8 of the support structure 5 are now released to the underwater floor 2. The work emitting sound can then commence. Once the object 1 has been inserted into the underwater floor 2, the floor element 12 is moved into the intermediate position or into the idle position and the parts of the underwater sound damper 4 are moved away from one another once again until the open position is reached. The vessel 20 can then be moved to a new insertion position and the process can start over again.

Figure 17:
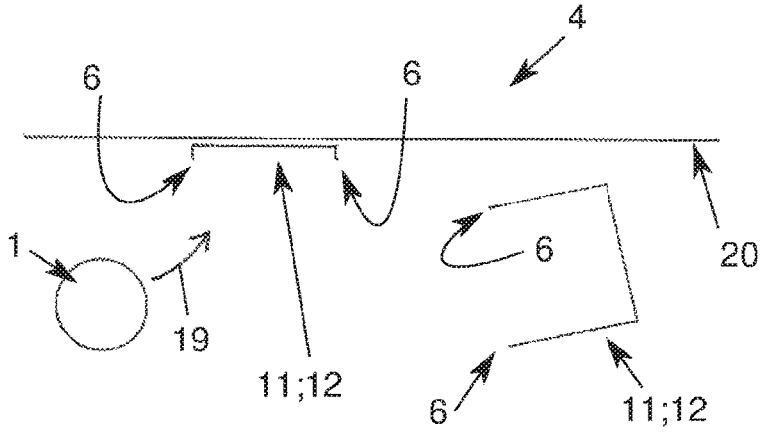
FIG. 17 a schematic plan view of an underwater sound damper in an open position.
Figure 18:
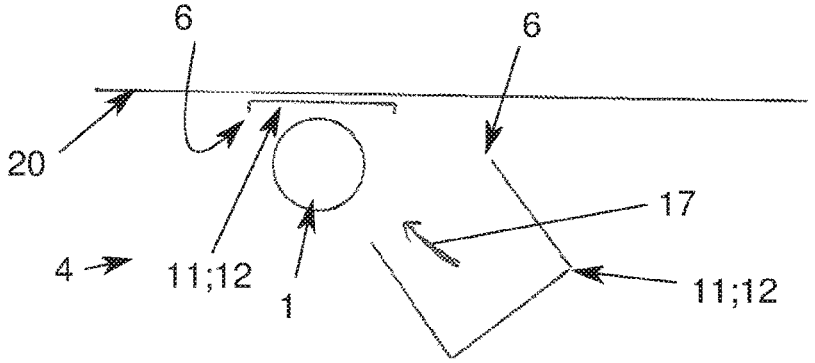
FIG. 18 a schematic plan view of the underwater sound damper shown in FIG. 17.
Figure 19:
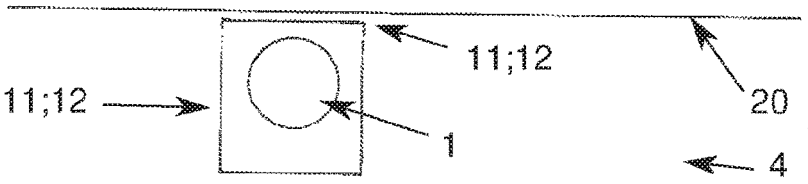
FIG. 19 a schematic plan view of the underwater sound damper shown in FIG. 17 in a closed position.

FIGS. 17 to 19 show a second variant of the method. In the second variant, too, an underwater sound damper 4 made up of at least two parts is also provided, in which each part comprises a retaining element 11 and a floor element 12, as well as a support structure 5 arranged therebetween. In this case, one part of the underwater sound damper 4 is fastened to a vessel 20, while the other part can move relative to the vessel 20 in a floating manner. When the underwater sound damper 4 is in the open position (FIG. 17), the object 1 is positioned 19 in its insertion location. The floating part of the underwater sound damper 4 is then moved 17 relative to the part fastened to the vessel 20 (FIG. 18). While the object 1 is being inserted into the underwater floor 2, the underwater sound damper 4 remains in the closed position (FIG. 19).

Figure 20:
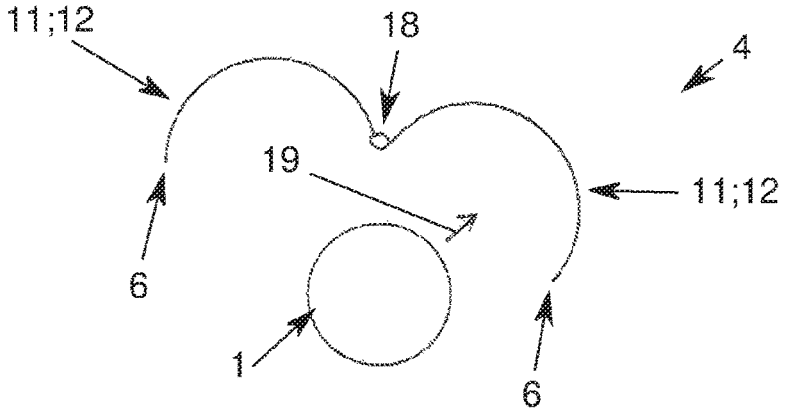
FIG. 20 a schematic plan view of an underwater sound damper in an open position.
Figure 21:
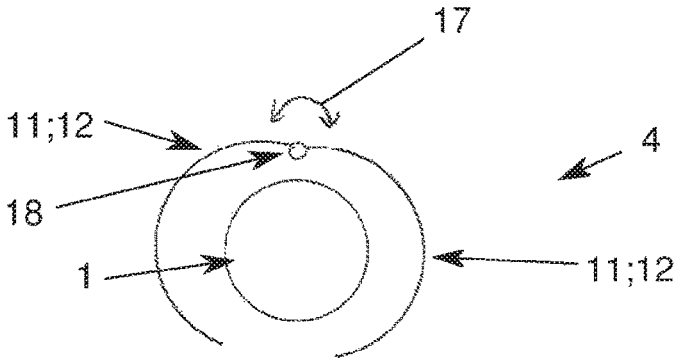
FIG. 21 a schematic plan view of the underwater sound damper shown in FIG. 20.
Figure 22:
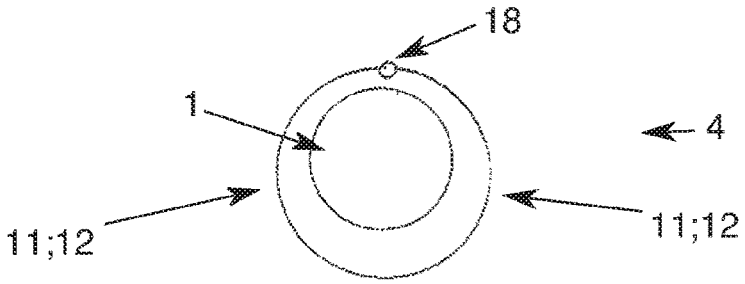
FIG. 22 a schematic plan view of the underwater sound damper shown in FIG. 20 in a closed position.

FIGS. 20 to 22 show a third variant of the method. In this third variant, an underwater sound damper 4 is provided, in which the two retaining elements 11 are pivotally interconnected. This underwater sound damper 4 preferably also comprises two floor elements 12, one floor element 12 being assigned to each retaining element 11. The floor elements 12 are also pivotally interconnected. Alternatively, the underwater sound damper 4 can also comprise a plurality of joint axles, for example consisting of four pairs, each pair comprising one retaining element 11 and one floor element 12, the four pairs being rotatably interconnected by means of three joint axles. Each pair covers a quadrant in this case, and therefore the closed underwater sound damper 4 engages around the object 1. The underwater sound damper 4 can be fastened to a vessel 20 and/or to a lifting device and/or to a guide device 15, can be retained by a crane on the vessel 20 or can be released from the vessel 20, for example it can move independently in a floating manner. As described above, the object 1 is positioned 19 when the underwater sound damper 4 is in the open position (FIG. 20). The underwater sound damper 4 is then closed by at least one pivot movement 17 of at least one pair comprising a retaining element 11 and a floor element 12 (FIG. 21), until the closed position (FIG. 22) is reached and therefore the underwater sound damper 4 surrounds the object 1.

Figure 23:
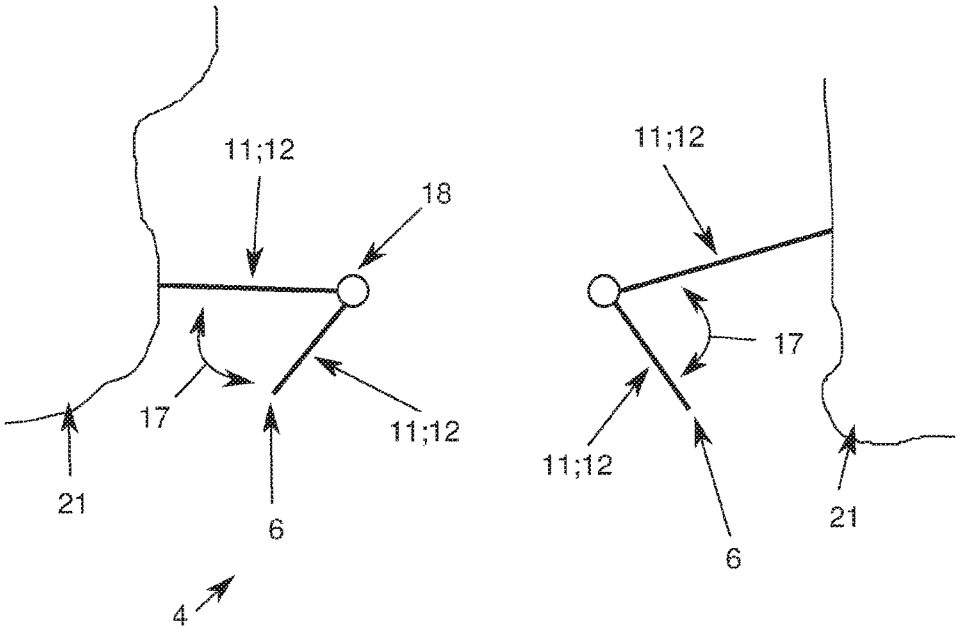
FIG. 23 a schematic plan view of an underwater sound damper in an open position.
Figure 24:
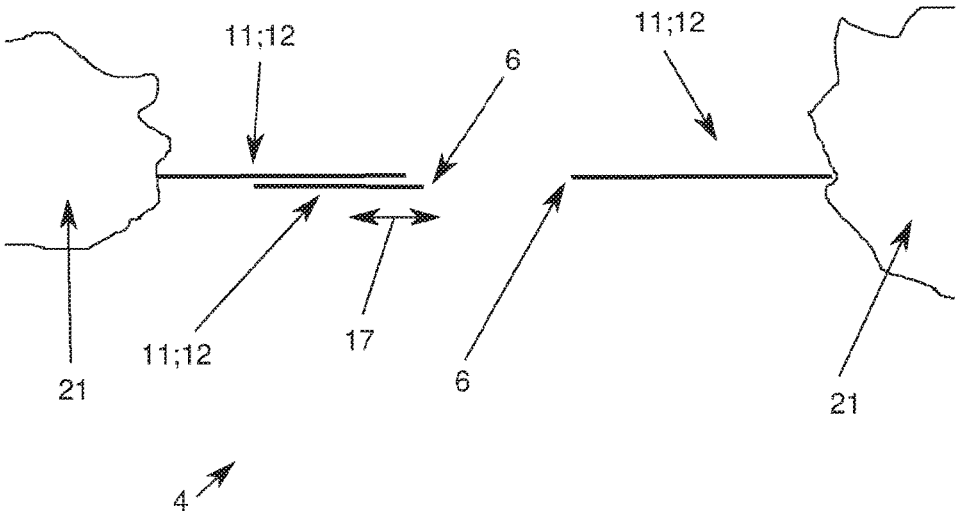
FIG. 24 a schematic plan view of an underwater sound damper in an open position.

FIGS. 23 and 24 show the method for handling the underwater sound damper 4 and an object 1 in a construction site between two spits 21. In a construction site between two spits 21, it is often sufficient to spread out the underwater sound damper between the two spits 21 in order to protect animals from underwater sound. The spits 21 can be two jetties in a harbor region or can form a bay on the coast. In the region of inland waters, the spits 21 are opposite banks of a river or two bank portions of a lake. The support structure 5 is in this case rigid and consists of a grating, for example. The use of a rigid support structure 5 has proven to be advantageous in particular in an underwater sound damper 4 that remains in the same place for a long time, i.e. is never or only seldom displaced. Alternatively to a grating, it is also possible to use cages, in particular narrow cages, wire mats, plastics mats, perforated sheet plates or rigid and/or flexible wire meshes and/or plastics meshes.

FIG. 23 shows a fourth variant of the method according to the invention. In this fourth variant, a multi-part underwater sound damper 4 is provided, in which each part comprises a support structure 5, at least two retaining elements 11 and at least two floor elements 12. The retaining elements 11 and the floor elements 12 of each part are pivotally interconnected. When moving 17 between the open position and the closed position, the associated pairs consisting of a retaining element 11 and a floor element 12 are collectively rotated around a bearing 18.

FIG. 24 shows a fifth variant of the method according to the invention. In this fifth variant, a multipart underwater sound damper 4 is provided, in which each part comprises a support structure 5, a retaining element 11 and a floor element 12. Two parts of the underwater sound damper 4 are positioned between the spits 21 in the manner of walls. There is a gap between said two parts. The gap can be closed by the at least one additional part. The at least one additional part is moved 17 relative to the two other parts, for example in a translational manner, between the open position and the closed position of the underwater sound damper 4.

Figure 25:
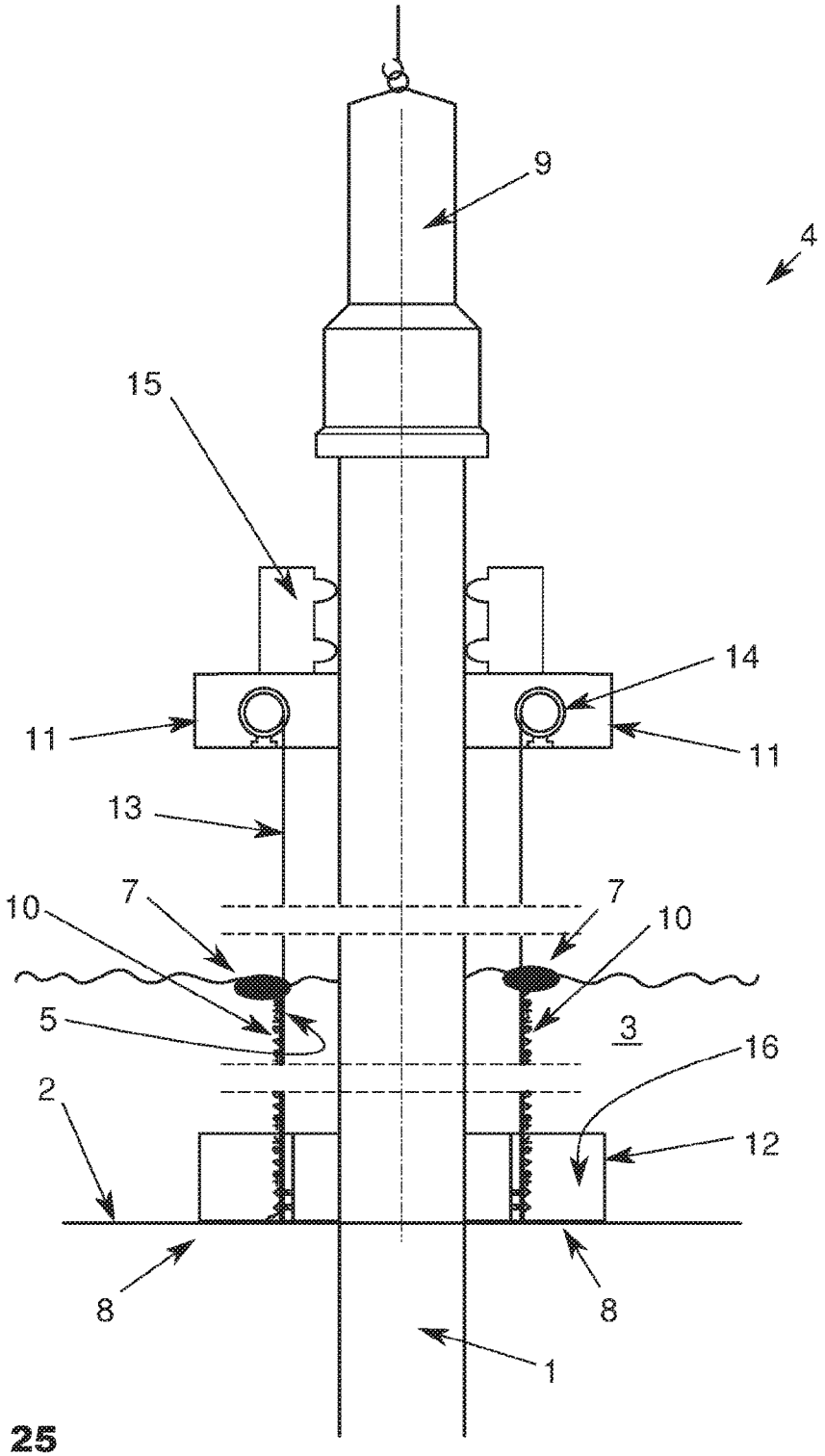
FIG. 25 a schematic sectional view of an underwater sound damper in a working position.

FIG. 25 shows an underwater sound damper 4, which is similar to the underwater sound damper 4 shown in FIGS. 1 to 3. In the underwater sound damper 4 shown in this case, the retaining elements 11 and the floor elements 12 are connected by means of cables 13, the floor elements 12 being movable relative to the retaining elements 11 by means of hoists 14 arranged on the retaining elements 11 or on the guide device 15. The floor element 12 is formed as a transport housing 16, which receives the support structure 5 comprising the sound-reducing elements 10 outside the water 3. The transport housing 16 is preferably an open-top mesh cage. If the floor element 12 is released into the water 3, the sound-reducing elements 10 float. Retained on the support structure 5, which is connected to the floor element 12 by its lower end 8, the support structure 5 and the sound-reducing elements 10 are pulled as far as to the underwater floor 2 and are therefore expanded over the entire water column. The upper end 7 of the support structure 5 floats freely on the surface of the water. The retaining elements 11 are fixed to the guide device 15 by means of cables or shackles. Once the object 1 has been positioned, the underwater sound damper 4 is closed. After closing said damper, the floor element 12 is lowered. The underwater sound damper 4 is preferably opened and closed above the water surface, the sound-reducing elements 10 not obtaining any buoyancy.

Figure 26:
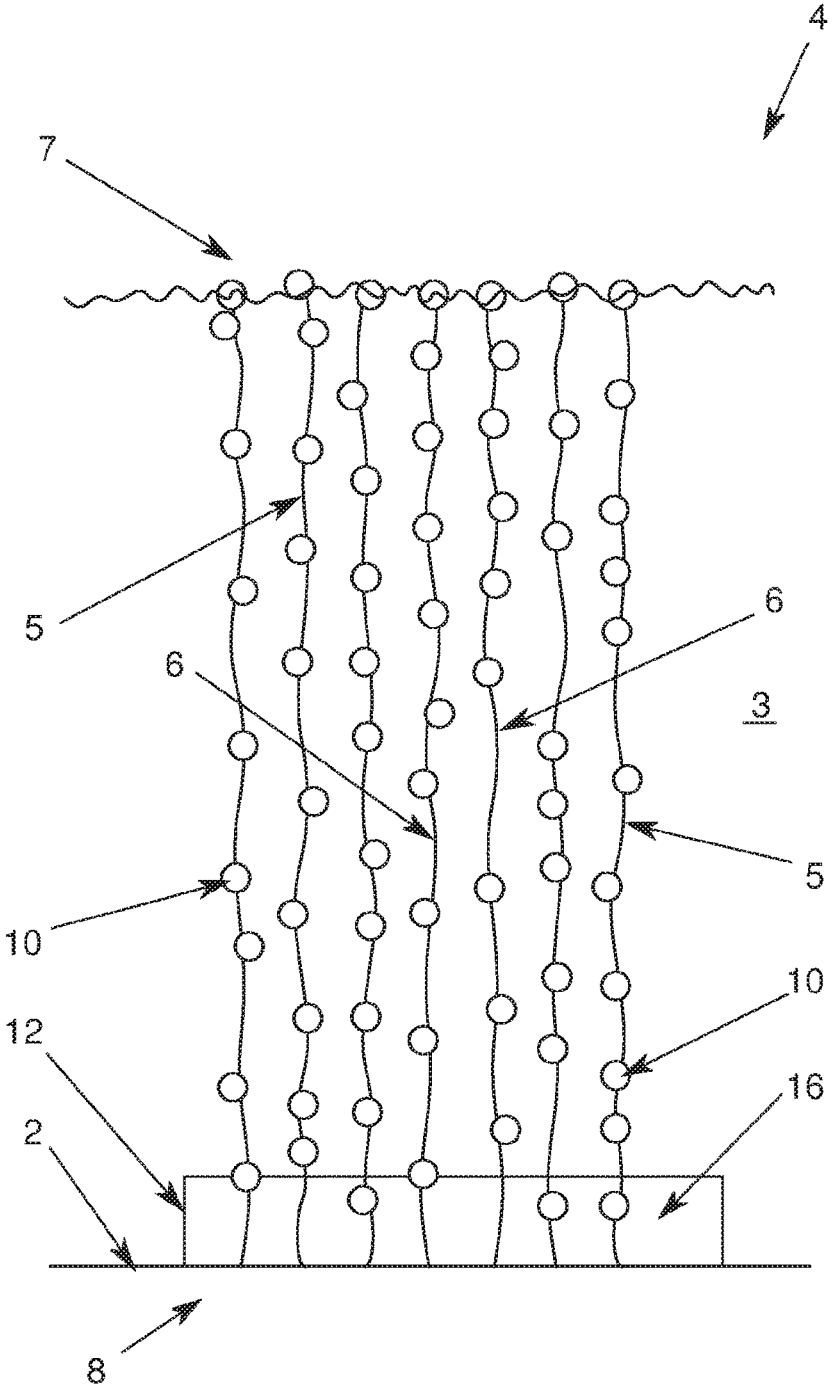
FIG. 26 a schematic sectional view of an underwater sound damper in a working position.

FIG. 26 shows a particular embodiment of an underwater sound damper 4, in which a floor element 12 has been set down on the underwater floor 2. Numerous support structures 5 that comprise sound-reducing elements 10 and are also independent of one another are arranged on said floor element 12. The support structures 5 are connected to the floor element 12 by means of their lower ends 8, which prevents the support structures 5 and the sound-reducing elements 10 rising any more. The support structures 5 consist of individual cables or of narrow net strips or are individual net tubes, in the interior of which the sound-reducing elements 10 are arranged. Each of the support structures 5 comprises a side edge 6 facing the adjacent support structures 5. This embodiment of the underwater sound damper 4 is separated in multiple places and can therefore be easily penetrated, since the upper ends 7 of the support structures 5 are free and give way to a passing object 1.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. An underwater sound damper for reducing waterborne sound when inserting an object into an underwater floor, the underwater sound damper having an upper end and a lower end opposite the upper end, the underwater sound damper comprising:

at least two retaining elements disposed near the upper end;

at least one floor element disposed near the lower end;

at least one support structure having side edges that extend between the upper end and the lower end, the at least one support structure being connected to the at least two retaining elements and connected, and movable relative to, the at least one floor element, the at least one support structure comprising a plurality of parallel and vertical cables and/or a plurality of parallel and vertical net strips and/or a plurality of parallel and vertical netting tubes and/or a net; and sound-reducing elements fastened to the at least one support structure and spaced apart from one another, wherein the at least two retaining elements are translationally movable relative to one another such that the underwater sound damper is separable along the side edges and movable between a closed position and an open position, and wherein the at least one floor element is translationally movable in a vertical direction relative to the at least two retaining elements between the underwater floor and the at least two retaining elements so as to adjust the underwater sound damper between a working position, in which the at least one floor element is disposed on the underwater floor, and an idle position, in which the at least one floor element rests against the at least two retaining elements.

2. The underwater sound damper of claim 1, wherein the at least one floor element moves in parallel with the side edges in the vertical direction and/or in a horizontal direction that is perpendicular to the vertical direction.

3. The underwater sound damper of claim 1, wherein the at least one floor element comprises a plurality of floor elements, which are configured to be moved together with the at least two retaining elements.

4. The underwater sound damper of claim 3, wherein the at least two retaining elements are configured to be moved relative to one another and/or the plurality of floor elements are configured to be moved relative to one another in a translational and/or rotary manner in a horizontal direction that is perpendicular to the vertical direction.

5. The underwater sound damper of claim 1, further comprising:

a guide device configured to surround the object, wherein at least one of the at least two retaining elements is fastened to the guide device.

6. A method for handling and/or positioning the underwater sound damper of claim 1 in a region of a construction site for the object to be inserted into the underwater floor, the method comprising:

providing the underwater sound damper of claim 1; and moving the underwater sound damper into the open position, in order to move the object through a plane of the underwater sound damper, in which open position the side edges are moved away from one another, or moving the underwater sound damper into the closed position, in order to insert the object into the underwater floor, in which closed position the side edges are moved towards one another.

7. The method of claim 6, further comprising:

moving the object to an insertion position; then moving the underwater sound damper from the open position into the closed position, the object being retained by a guide device such that the object cannot move horizontally and is enclosed by the at least two retaining elements; then expanding the at least one support structure, a lower end of the at least one support structure being moved to the underwater floor or as far as the at least one floor element resting on the underwater floor; then inserting the object into the underwater floor using an insertion apparatus; then contracting the at least one support structure at least in part, the lower end of the at least one support structure being moved away from the underwater floor; and then moving the underwater sound damper from the closed position into the open position to release the object.

8. The method of claim 6, comprising, in the underwater sound damper wherein the at least one support structure comprises one support structure, in order to reach the closed position, reducing a distance between the side edges, which extend between an upper end and a lower end of the one support structure, or, in the underwater sound damper wherein the at least one support structure comprises at least two support structures, reducing the distance between two side edges of the side edges of a first of the at least two support structures and a second of the at least two support structures.

9. The method of claim 6, further comprising:

collectively moving a guide device and the at least two retaining elements so as to adjust the underwater sound damper from the open position into the closed position.

10. The underwater sound damper of claim 1, wherein the at least one support structure comprises more than one support structure.

11. The underwater sound damper of claim 1, wherein the at least one support structure comprises the plurality of parallel and vertical cables.

12. The underwater sound damper of claim 1, wherein the at least one support structure comprises the plurality of parallel and vertical net strips.

13. The underwater sound damper of claim 1, wherein the support structure comprises the plurality of parallel and vertical netting tubes.

14. The underwater sound damper of claim 1, wherein the support structure comprises the net.

15. The underwater sound damper of claim 1, wherein the at least one support structure comprises a plurality of support structures, which are configured to be moved together with the at least two retaining elements.

16. The underwater sound damper of claim 1, wherein the at least one floor element comprises a plurality of floor elements and the at least one support structure comprises a plurality of support structures, which plurality of support structures are configured to be moved together with the at least two retaining elements.

* * * * *